US006881935B2

(12) United States Patent
Kim et al.

(10) Patent No.: US 6,881,935 B2
(45) Date of Patent: Apr. 19, 2005

(54) MICROWAVE OVEN

(75) Inventors: Kyoung Ho Kim, Suwon (KR); Jae Man Cho, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/443,784

(22) Filed: May 23, 2003

(65) Prior Publication Data

US 2004/0144775 A1 Jul. 29, 2004

(30) Foreign Application Priority Data

Jan. 24, 2003 (KR) ..... 10-2003-0004858

(51) Int. Cl.[7] ..... H05B 6/68
(52) U.S. Cl. ..... 219/702; 219/757
(58) Field of Search ..... 219/702, 714, 219/715, 720, 746, 756, 757, 406, 681, 506; 126/21 A, 273 A, 299 R, 299 D, 198

(56) References Cited

U.S. PATENT DOCUMENTS 4,872,008 A * 10/1989 Ohtsuka et al. ..... 341/26
4,894,493 A 1/1990 Smith et al.
5,274,209 A * 12/1993 Edamura ..... 219/714
6,097,016 A * 8/2000 Hirata et al. ..... 219/720
6,300,609 B1 * 10/2001 Kim ..... 219/702

FOREIGN PATENT DOCUMENTS

JP 5-126344 5/1993
JP 2002-39537 2/2002

* cited by examiner

*Primary Examiner*—Quang T. Van
(74) *Attorney, Agent, or Firm*—Staas & Halsey LLP

(57) ABSTRACT

A microwave oven includes a control panel having a panel casing, a membrane board, and a cover sheet. The membrane board is mounted to a front surface of the panel casing. A membrane board seat is formed at a predetermined area of the front surface of the panel casing so as to seat the membrane board. The control panel further includes an air discharging channel which is provided on the membrane board seat, and discharges air existing between the membrane board seat and the membrane board. The air discharging channel may extend to a cover sheet-panel casing interface. Accordingly, air existing between the panel casing, the membrane board and the cover sheet is discharged to the outside as the panel casing, the membrane board and the cover sheet are attached to each other.

5 Claims, 4 Drawing Sheets

MICROWAVE OVEN

CROSS-REFERENCE TO RELATED APPLICATIONS

This application claims the benefit of Korean Application No. 2003-4858, filed Jan. 24, 2003, in the Korean Intellectual Property Office, the disclosure of which is incorporated herein by reference.

BACKGROUND OF THE INVENTION

1. Field of the Invention

The present invention relates to microwave ovens, and more particularly, to a microwave oven comprising a control panel having an air discharging structure.

2. Description of the Related Art

Generally, a microwave oven is an appliance which cooks food using microwaves. That is, the microwave oven cooks food by heating the interior of the food through a dielectric heating method. The microwave oven includes a cooking cavity which receives food, and a magnetron which irradiates microwaves into the cooking cavity. A door is mounted to a front of the cooking cavity to open or close the cooking cavity. A control panel is mounted to a front of a machine room having electrical devices including the magnetron. The control panel is provided with a plurality of control pads to control an operation of the microwave oven, and a display to display an operating state of the microwave oven.

FIG. 1 shows a control panel of a conventional microwave oven. The control panel includes a panel casing 1. A membrane board 2 having a thin panel shape is mounted to a front surface of the panel casing 1. A cover sheet 3 is attached to a front surface of the membrane board 2. Several input keys are printed on an outer surface of the cover sheet 3. A circuit board 4 is mounted to a rear surface of the panel casing 1. An opening 6 is provided at an upper portion of the panel casing 1 so as to receive a display 5. The display 5 comprises an LCD or a touch screen.

The front of the panel casing 1 is recessed by a predetermined depth to form a flat membrane board seat 8, so as to seat the membrane board 2 in the membrane board seat 8. The membrane board 2 is attached to the membrane board seat 8 using a double-sided adhesive tape (not shown) or an adhesive (not shown). The cover sheet 3 is attached to the front surface of the membrane board 2, in the same manner as the membrane board 2 is attached to the front surface of the panel casing 1.

However, the conventional control panel has a problem in that air may flow between the panel casing 1 and the membrane board 2, or between the membrane board 2 and the cover sheet 3 where the membrane board 2 is attached to the front surface of the panel casing 1, or the cover sheet 3 is attached to the front surface of the membrane board 2 using an adhesive tape or an adhesive. Accordingly, the membrane board 2 may come off from the panel casing 1, or the cover sheet 3 may come off from the membrane board 2 due to air bubbles, which are difficult to remove, resulting from the air flow.

Furthermore, air existing between the membrane board 2, the cover sheet 3, and the panel casing 1, which are attached to each other, may expand due to a temperature variation around the microwave oven as the microwave oven is used. Therefore, the cover sheet 3 may swell, thus deteriorating the appearance of the control panel.

SUMMARY OF THE INVENTION

Accordingly, it is an aspect of the present invention to provide a microwave oven having a control panel, which is designed such that air existing between a panel casing, a membrane board, and a cover sheet is discharged to the outside as they are attached to each other. Accordingly, the membrane board and the cover sheet are easily attached to the panel casing, and are maintained to have a good appearance.

Additional aspects and advantages of the invention will be set forth in part in the description which follows and, in part, will be obvious from the description, or may be learned by practice of the invention.

To achieve the above and/or other aspects of the present invention, there is provided a microwave oven comprising a cooking chamber which receives food, a heating unit which cooks the food, and a control panel which controls an operation of the microwave oven, wherein the control panel includes a panel casing, a membrane board which is mounted to a front surface of the panel casing, a membrane board seat which is formed at a predetermined area of the front surface of the panel casing so as to seat the membrane board, and an air discharging channel which is provided on the membrane board seat and discharges air existing between the membrane board seat and the membrane board.

The control panel may further include a cover sheet having a dimension which is larger than the membrane board, attached to a front surface of the membrane board, and includes input keys which are printed on an outer surface of the cover sheet, and a sheet attaching part which is provided on the panel casing along an outside of an edge of the membrane board seat so as to attach the cover sheet to the panel casing, wherein the air discharging channel extends to the sheet attaching part.

The air discharging channel may be provided with at least one air discharging hole which is bored through the panel casing to a rear of the panel casing.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
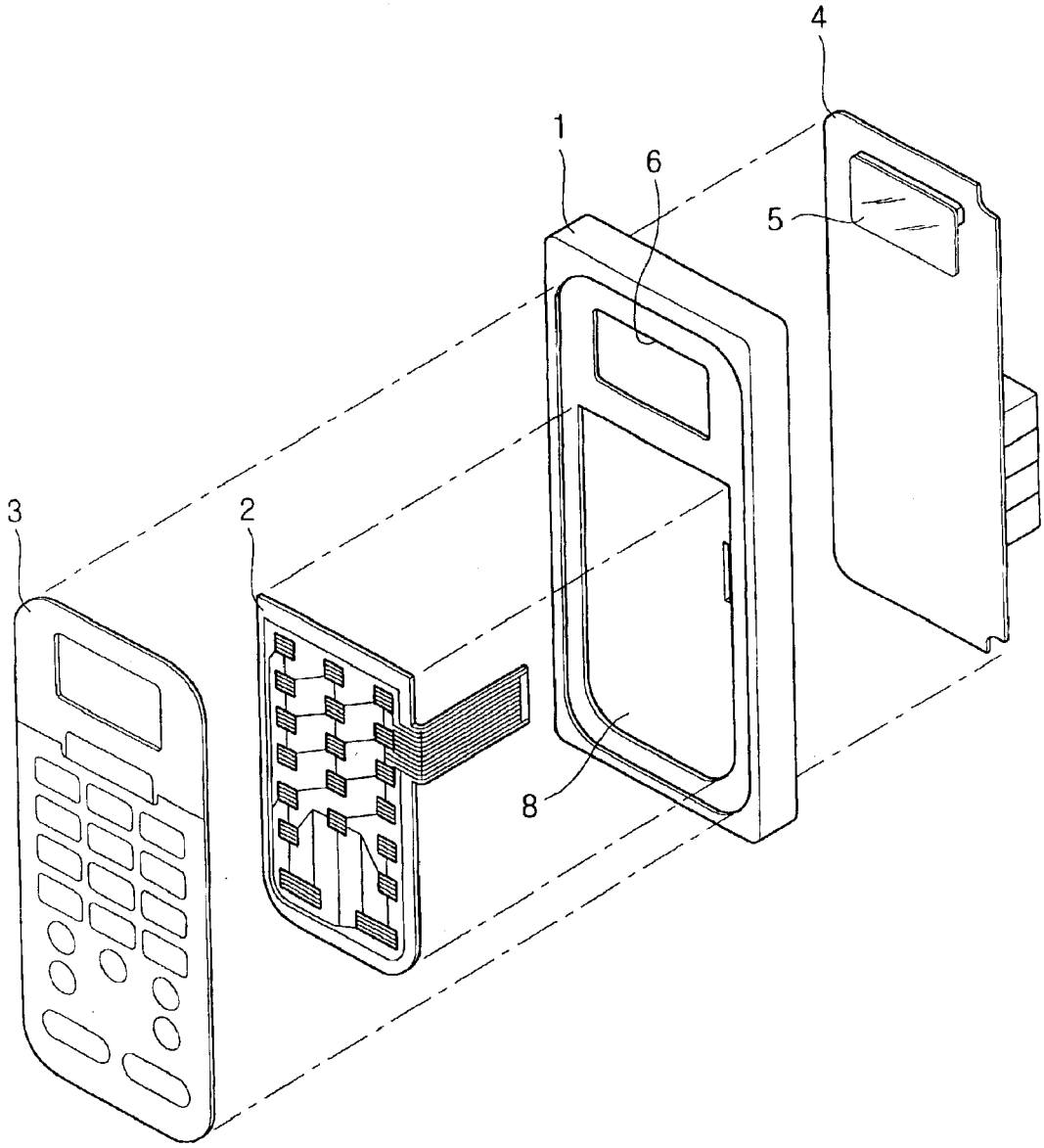
FIG. 1 (Prior Art)
FIG. 1 is an exploded perspective view of a control panel of a conventional microwave oven.

Reference will now be made in detail to the present preferred embodiments of the present invention, examples of which are illustrated in the accompanying drawings, wherein like reference numerals refer to like elements throughout.

Figure 2:
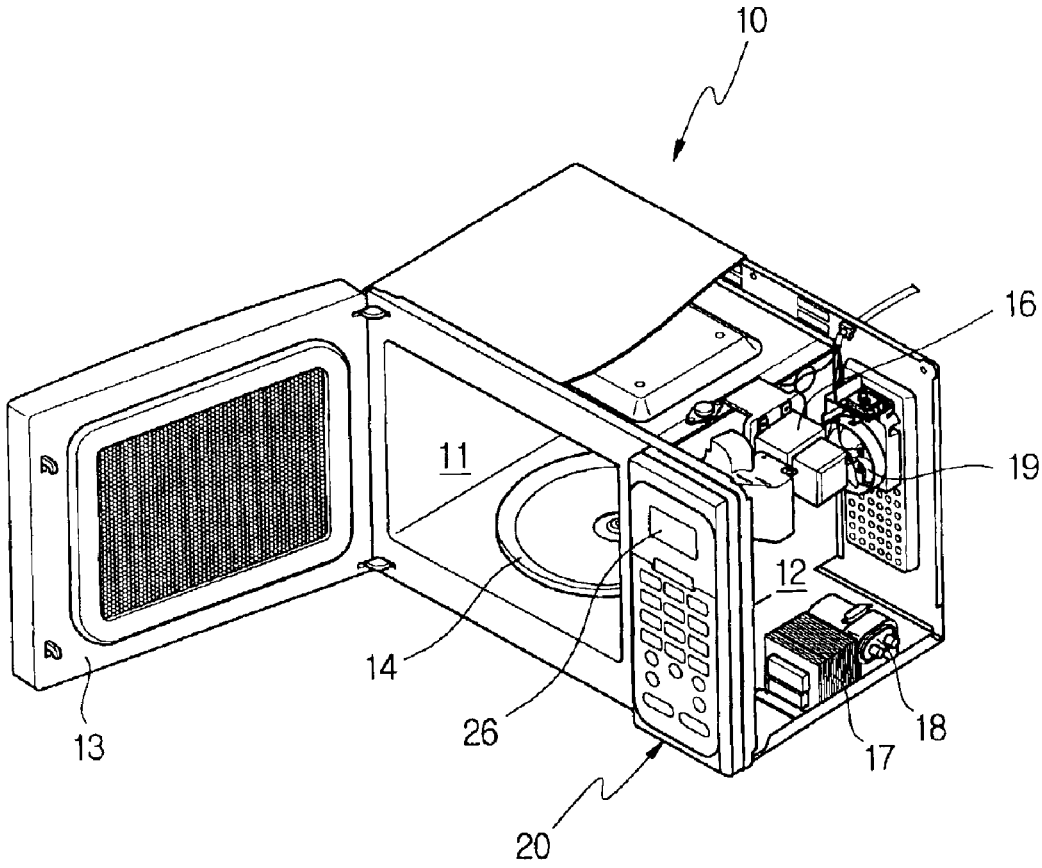
FIG. 2 is a perspective view of a microwave oven according to an embodiment of the present invention.

FIG. 2 shows a microwave oven according to an embodiment of the present invention. The microwave oven includes a cabinet 10 which is partitioned into a cooking cavity 11 and a machine room 12. Food to be cooked is laid in the cooking cavity 11. Several electrical devices are installed in the machine room 12. The cooking cavity 11 is opened at its front to allow the food to be placed or removed from the cooking cavity 11. A door 13 is mounted to the front of the cooking cavity 11 to open or close the cooking cavity 11. A rotatable cooking tray 14, which receives the food thereon, is installed in the cooking cavity 11.

The electrical devices, including a magnetron 16, a high-voltage transformer 17, a high-voltage condenser 18, and a circulating fan 19, are installed in the machine room 12. The magnetron 16 irradiates microwaves into the cooking cavity 11. The high-voltage transformer 17 and the high-voltage condenser 18 apply a high voltage to the magnetron 16. The circulating fan 19 cools the machine room 12. A control panel 20 is mounted to a front of the machine room 12. The control panel 20 is provided with a plurality of control pads to control an operation of the microwave oven, and a display to display an operating state of the microwave oven.

Figure 3:
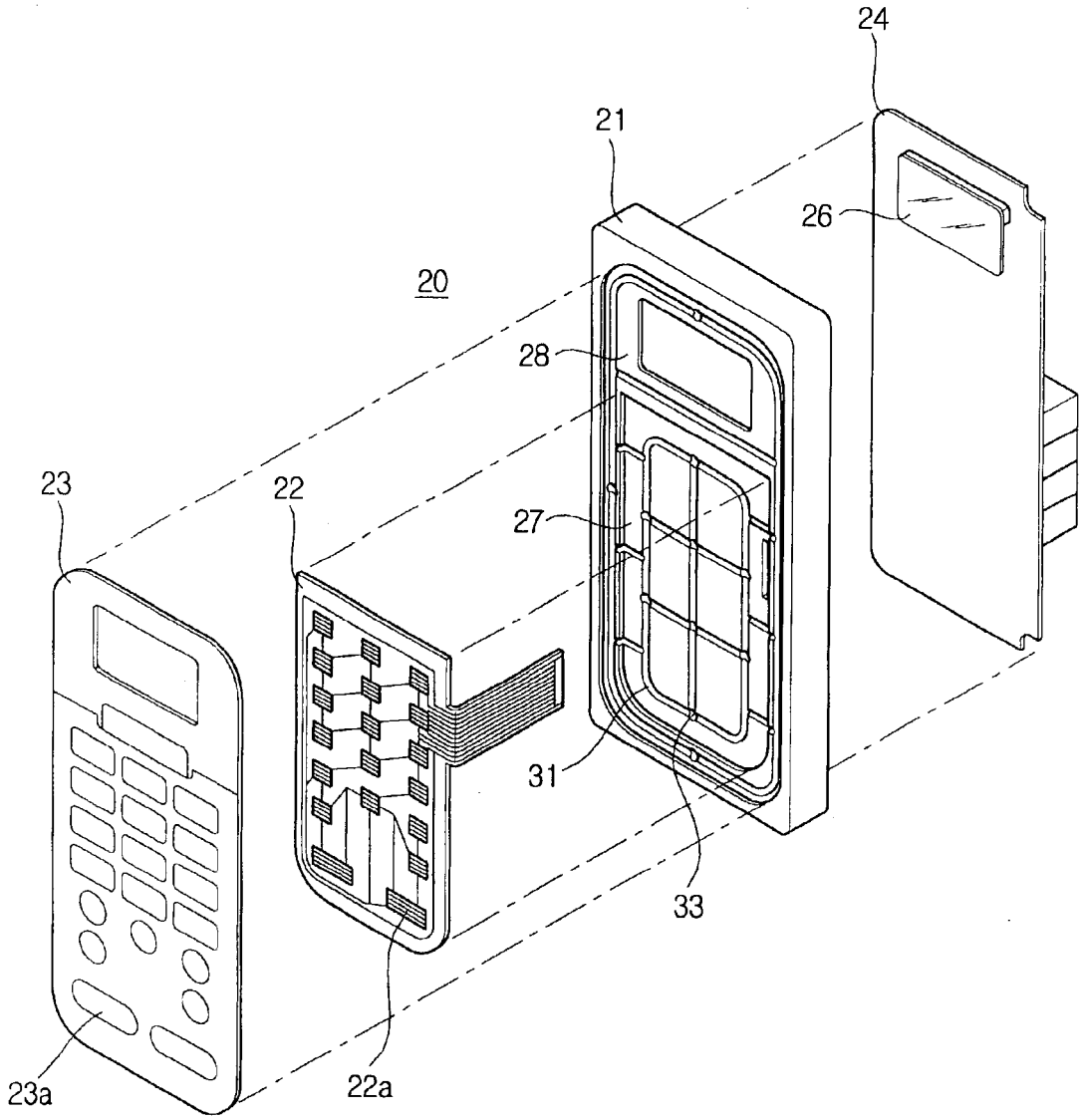
FIG. 3 is an exploded perspective view of a control panel of the microwave oven shown in FIG. 2.
Figure 4:
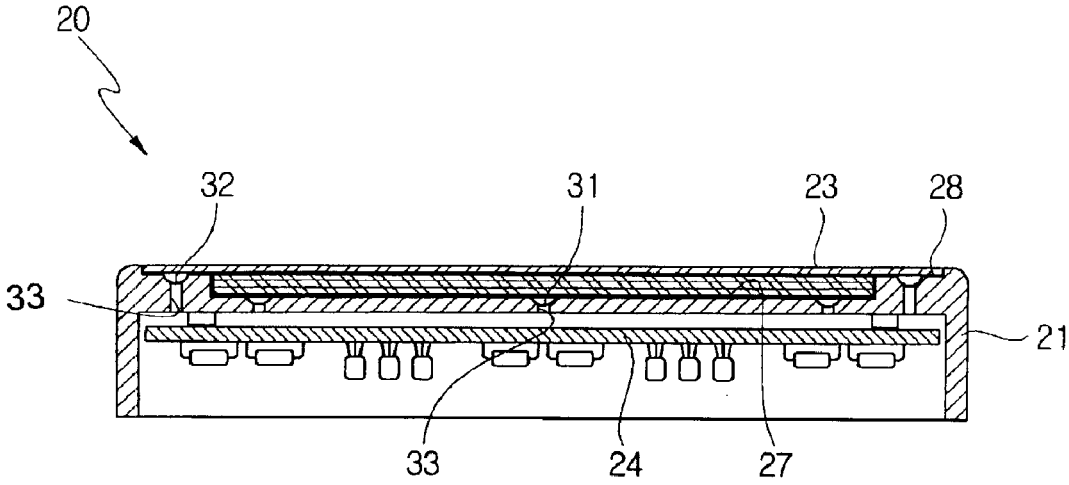
FIG. 4 is a sectional view of the control panel of the microwave oven shown in FIG. 2.

FIGS. 3 and 4 show the control panel 20 of the microwave oven shown in FIG. 2. The control panel 20 includes a panel casing 21 which has a size corresponding to the front of the machine room 12, a membrane board 22 which is mounted to a front surface of the panel casing 21, a cover sheet 23 which is attached to a front surface of the membrane board 22, and a circuit board 24 which is mounted to a rear surface of the panel casing 21 and controls an operation of the microwave oven.

The membrane board 22 has a thin panel shape which is provided with a plurality of control pads 22*a*. The cover sheet 23 has a film shape. A plurality of input keys 23*a* are printed on an outer surface of the cover sheet 23 at positions corresponding to the control pads 22*a* of the membrane board 22. The cover sheet 23 has a size larger than the membrane board 22 to wholly cover the membrane board 22 and a portion outside of an edge of the membrane board 22. The control panel 20 also includes a display 26. The display 26 is mounted to an upper portion of the circuit board 24 and is positioned in an opening formed at an upper portion of the panel casing 21, and may comprise an LCD or a touch screen.

The front of the panel casing 21 is recessed/depressed by a predetermined depth to form a flat membrane board seat 27 having a size corresponding to the membrane board 22, thus allowing the membrane board 22 to be seated in the membrane board seat 27. A sheet attaching part 28 is provided on the panel casing 21 along an outside of an edge of the membrane board seat 27 so as to have the cover sheet 23 attached to the panel casing 21. In this case, the membrane board 22 may be attached to the membrane board seat 27 using a double-sided adhesive tape or an adhesive. The cover sheet 23 is attached to the front surface of the membrane board 22 and the sheet attaching part 28, in the same manner as the membrane board 22.

As illustrated in FIGS. 3 and 4, air discharging channels 31 and 32 are provided on the membrane board seat 27 and the sheet attaching part 28, respectively, thus allowing air existing between the membrane board 22, the cover sheet 23, and the panel casing 21 to be smoothly discharged to the outside, where the membrane board 22 and the cover sheet 23 are attached to the panel casing 21 during a manufacturing process of the control panel 20.

The air discharging channels 31 and 32 comprise a plurality of channels which are connected to each other so as to communicate with each other. The air discharging channel 31 of the membrane board seat 27 is connected to the air discharging channel 32 of the sheet attaching part 28. Each of the air discharging channels 31 and 32 is provided with a plurality of air discharging holes 33 which are bored from the air discharging channel 31 or 32 through the panel casing 21 to a rear of the panel casing 21, thus allowing air to be discharged to the rear of the panel casing 21.

Where the membrane board 22 is attached to the membrane board seat 27 and the cover sheet 23 is attached to the sheet attaching part 28 to manufacture the control panel 20, air existing between the membrane board 22 and the membrane board seat 27 or between the cover sheet 23 and the sheet attaching part 28 is discharged through the air discharging channels 31 and 32 and the air discharging holes 33 to the outside, thus preventing air bubbles from being generated between the membrane board 22 and the membrane board seat 27, or between the cover sheet 23 and the sheet attaching part 28, and allowing the membrane board 22 and the cover sheet 23 to be easily attached to the membrane board seat 27 and the sheet attaching part 28, respectively.

Such a construction prevents air between the membrane board 22 and the membrane board seat 27, or between the cover sheet 23 and the sheet attaching part 28, from existing therebetween where the membrane board 22 is attached to the membrane board seat 27, or the cover sheet 23 is attached to the sheet attaching part 28. Thus, although heat may be applied to the membrane board 22 and the cover sheet 23 during an operation of the microwave oven, the membrane board 22 and the cover sheet 23 do not swell due to the expansion of air, and are maintained to have a good appearance.

As described above, the present invention provides a microwave oven having a control panel, which is designed such that air existing between a membrane board and a membrane board seat or between a cover sheet and a sheet attaching part is discharged to the outside through air discharging channels and air discharging holes. The air discharging channels and the air discharging holes are provided on the membrane board seat and the sheet attaching part of a panel casing, thus allowing the membrane board and the cover sheet to be easily attached to the membrane board seat and the sheet attaching part, respectively, and preventing the cover sheet from swelling due to the expansion of air.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooking apparatus comprising:

a cooking chamber which receives food;

a heating unit which cooks the food; and a control panel which controls an operation of the cooking apparatus, wherein the control panel comprises:

a panel casing having one or more air discharging channels, and a control board which is mounted directly to the panel casing, wherein the one or more air discharging channels discharge air existing between the control board and the panel casing.

2. The cooking apparatus according to claim 1, wherein the one or more air discharging channels include at least one air discharging hole which discharges the air away from a control board-panel casing interface.

3. The cooking apparatus according to claim 1, wherein:

the control panel further comprises a cover sheet which covers the control board, and the one or more air discharging channels extend to an interface between the cover sheet and the panel casing.

4. The cooking apparatus according to claim 3, wherein:

the control board is mounted on a first surface level of a front side of the panel casing, the cover sheet is mounted on a second surface level of the front side of the panel casing, and the one or more air discharging channels discharge the air existing between the cover sheet, control board and the panel casing.

5. The cooking apparatus according to claim 1, wherein the heating unit includes a magnetron which generates microwaves.

* * * * *